United States Patent [19]

Bergmann

[11] 4,031,948

[45] June 28, 1977

[54] MOLD-EQUIPPED CASTING OVEN UNIT FOR CONTINUOUS ROD CASTINGS

[75] Inventor: Bernhard Bergmann, Balsthal, Switzerland

[73] Assignee: Von Roll AG, Gerlafingen, Switzerland

[22] Filed: June 13, 1975

[21] Appl. No.: 586,842

[30] Foreign Application Priority Data

June 15, 1974 Switzerland ..... 8203/74
Jan. 17, 1975 Switzerland ..... 545/75

[52] U.S. Cl. ..... 164/281 H; 164/282
[51] Int. Cl.[2] ..... B22D 11/10; B22D 11/128
[58] Field of Search ..... 164/281, 336, 337, 282, 164/281 H, 323, 324, 337

[56] References Cited

UNITED STATES PATENTS

| | | | |
|---|---|---|---|
| 2,768,413 | 10/1956 | Alexanderson | 164/337 X |
| 3,218,682 | 11/1965 | Namy | 164/337 |
| 3,273,208 | 9/1966 | Greenberger | 164/281 |
| 3,375,862 | 4/1968 | Boitchenko | 164/281 |
| 3,472,309 | 10/1969 | Calderon | 164/281 X |
| 3,495,651 | 2/1970 | Rokop | 164/282 X |
| 3,506,063 | 4/1970 | Dain | 164/281 |
| 3,598,173 | 8/1971 | Dore | 164/281 X |

*Primary Examiner*—Robert D. Baldwin
*Assistant Examiner*—John S. Brown
*Attorney, Agent, or Firm*—William R. Woodward

[57] ABSTRACT

While a mold assembly providing an antechamber for the mold is fixed in the operating position, another such mold antechamber assembly is set up, adjusted and preheated in a standby position, and mechanical displacement arrangements make possible a rapid substitution of the mold assembly in the standby position for the mold assembly in the operating position, either in case trouble develops with the latter or when it is desired to shift from operations with a mold of one cross section to operations with a mold of another cross section. The cast rod is pulled horizontally out of the mold. Operating and standby positions are provided on a rotatable positioning table. A reservoir oven is arranged for discharging molten metal into the antechamber located in the operating position as needed to maintain the melt level in the antechamber of the operating mold assembly within prescribed limits.

4 Claims, 4 Drawing Figures

MOLD-EQUIPPED CASTING OVEN UNIT FOR CONTINUOUS ROD CASTINGS

This invention relates to a continuous rod casting equipment line for horizontally molding and pulling out a rod stem or stems, the equipment line including at least a mold and oven unit having a reservoir oven portion and a mold assembly and turntable portion and also a pulling equipment assembly melt-containing for pulling out the rod stem or stems. The apparatus of the invention is usable both for iron casting and for nonferrous metal casting.

Continuous rod casting equipment lines for cast iron and nonferrous metals are known in various forms. They require tending by a costly complement of operating personnel on account of the necessity of cooperation of a number of work stations within the line resulting in a complex equipment construction. The corresponding down time requirement for setting up, starting and closing down the line is accordingly relatively great, and, in addition, qualified personnel are required for these down time activities. The expense and the difficulty of coordinating the individual work stations of the equipment line also results in a relatively low precision, leading to variations in the product.

The disadvantages above described relating to continuous casting equipment lines in general also apply particularly to the drawing oven units of such lines, with which it is difficult if not impossible to provide uniform pulling conditions.

It is an object of the present invention to constitute a continuous rod casting equipment line in such a form that the shortcomings of the known types of continuous casting equipment lines are avoided and uniform pulling conditions can be obtained by maintaining constant operating parameters for the portions of the equipment and process situated ahead of the mold.

SUBJECT MATTER OF THE PRESENT INVENTION

Briefly, the mold assembly portion of the mold-equipped oven unit is constituted of two or more mold assemblies each forming an antechamber with the mold; and a rotary positioning table apparatus on which two or more antechambers are fixedly mountable respectively in respective predetermined positions in each of which one of the mold assemblies is in an operating position for horizontal continuous casting; and by which the mold assemblies are respective movable from an operating position to a standby position and back. Provision is made for heating an a mold assembly in the standby position and maintaining it in ready condition for substitution for the operating mold assembly. The positioning table rotatably mounted on an adjustable base and fixable with respect to the base at least in certain positions, the positioning table preferably having diametrically opposite mounting positions for a pair of mold assemblies.

Other features preferably provided in embodiments of the invention are: interchangeable front plates for the melt-containing mold assemblies on which the molds are mounted at the bottom of the effective mold surface at a reference level; the provision of a casting melt level monitor for an a mold assembly in the operation position, and control by such a monitor of the supply of melt from the reservoir oven portion of the oven unit, and also the provision of rod stem pulling equipment comprising a plurality of transversely shiftable pulling units each including a mounting frame carrying a pulling roll and a pressure roll.

The invention is further described by way of illustrative examples with reference to the accompanying drawings in which.

A continuous casting facility as here discussed is composed of a draw-casting oven unit, of which an illustrative embodiment is described below and shown in FIGS. 1 and 2, a roller table unit immediately downstream of the draw-casting oven unit on which the rod stem or stems issuing out of the oven unit are guided, a pulling equipment assembly, shown in FIGS. 3 and 4, and also a notching and severing unit not shown and not further described here, which may be of the form disclosed in my companion patent application Ser. No. 586,774, filed June 13, 1975.

Figure 2:
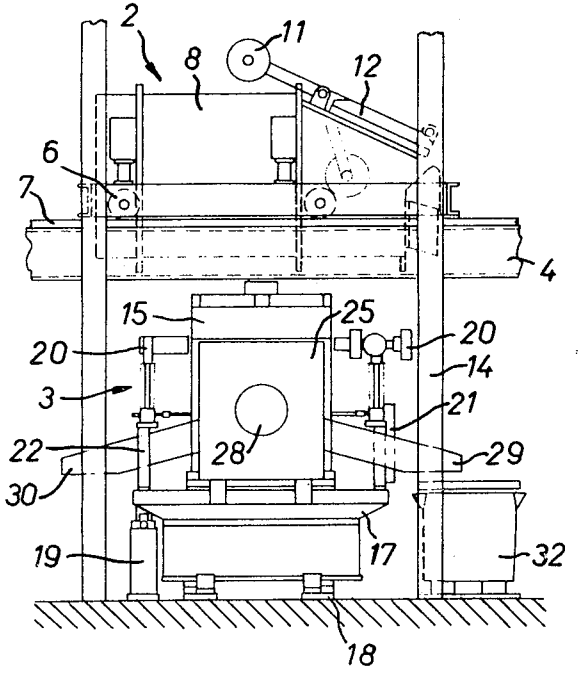
FIG. 2 is an end view of the oven unit of FIG. 1.
Figure 1:
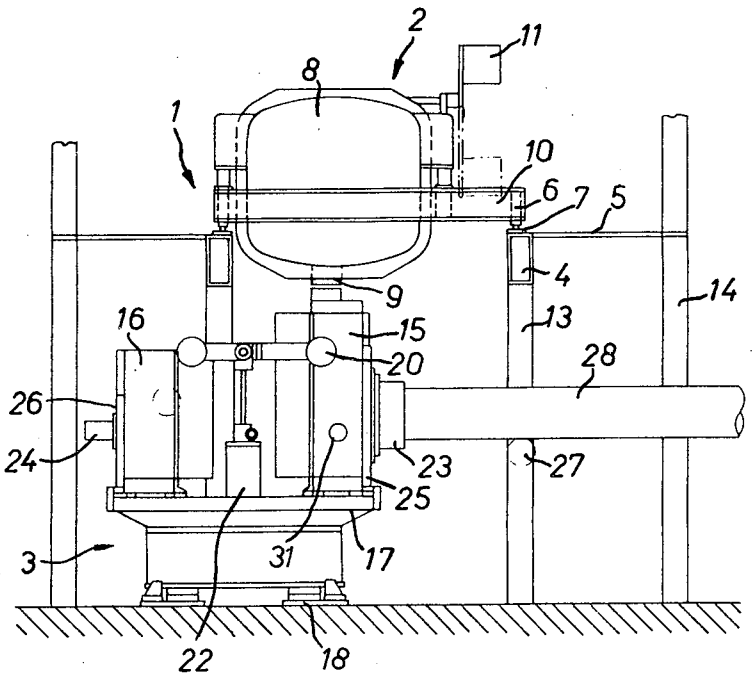
FIG. 1 is a side view of a first embodiment of a mold and oven unit for a horizontal continuous casting equipment line in accordance with the invention.

The oven equipment shown in FIGS. 1 and 2 is composed of a reservoir oven portion 2 and a mold antechamber portion 3. The reservoir oven portion 2 is disposed above the mold assembly and turntable 3 and is displaceable on support beams 4 of a platform 5 by means of wheels 6 rolling on rails 7. The reservoir oven portion comprises a closed container 8 supported on the traveling frame 10 and provided by a discharge opening 9 controllable by a stopper valve not specifically shown. The container 8 has, to the extent needed, also a heating means not specifically shown, for example an induction heating equipment. It also has a cover 12 provided with a counterweight 11, so that it may be kept continuously supplied with liquid metal by filling up from time to time. Other container types, for example tilting containers, could also be used instead of the reservoir oven 2 illustrated in FIGS. 1 and 2. The support beams 4 are parts of a not further illustrated framework that also includes a number of columns or pillars 13 and 14.

The mold assembly and turntable portion 3 of the mold and oven unit comprises a first mold assembly 15 and a second mold assembly 16, each providing a melt-containing antechamber for a mold forming one sidewall of the antechamber and both fastened in place on a rotatable positioning table 17. The positioning table 17 is supported on a pedestal frame 18 that is adjustable for leveling, so that whichever of the two mold assemblies 15 or 16 is located in the operating position will be positioned exactly in the correct position. Suitable apparatus for fixing the stationary positions of the rotatable table 17 are provided on or alongside the pedestal frame 18, for example the rotation stop 19.

The mold assembly 16 is located diametrically opposite the mold assembly 15 and as shown in FIG. 1 the mold 16 is in a standby position. It is important that it should be possible to mount, true up and preheat the mold assembly in the standby position on the positioning table without disturbing the operation of the facility. If the operating mold assembly 15 must be replaced, it is then possible to swing the mold assembly 16 available in the standby position into the operating position in a very short time and to restore and continue the operation of the continuous casting line after only a short interruption.

A built-in liquid level monitoring device 20 is also provided on the positioning table 17 that is mounted on two columns 22 in such a manner as to be displaceable in height by means of a height variation device 21. The monitoring device 20 could instead, however, operate with a different arrangement, for example one utilizing radioactive isotopes, for measuring the level of molten metal in the mold antechamber within the operating mold assembly. The level monitoring device 20 is utilized to control the supply of molten metal from a container 8, so that a static pressure in the antechamber, which may be referred to as ferrostatic pressure in the case of iron casting, may be maintained as constant as possible.

The mold assemblies 15 and 16 are each provided with a chill mold 23, 24 on their respective front faces, the chill mold being mounted on a face plate 25, 26. The face plates 25, 26 are interchangeable and are fastened into the mold assembly in a manner allowing precise positioning, so that, since the molds 23, 24 are also positionable precisely on their respective face plates, the corresponding face plates can be mounted without time-consuming adjustment work. It is particularly suitable to provide that the lowermost point of the effective mold cross section will always be situated at the same height. The set up and pre-installation of the mold assemblies in the standby position and the rapid interchangeability of the face plates makes possible a quick transition between pulling a cast rod of one cross section and pulling a cast rod of the next cross section required to be provided without the necessity of utilizing a large number of mold assemblies. It is important in this connection that the pedestal frame 18 should be adjustable so that the desired position of the bottom of the effective mold surface, or the bottom surface in the case of a flat bottom surface, may be maintained with reference to a downstream roller table unit indicated in FIG. 1 by the roller 27 shown in a dashed line. One or more rod stems 28 issuing out of the mold 23 may then be pulled without distortion or trouble over the roller 27 and the rest of the roller table unit in question.

The mold assemblies 15 and 16 are provided with lateral drain troughs, as shown in FIG. 2. These make it possible to empty the molten metal present in the mold antechamber into a container 32 from a laterally arranged emergency tap 31 (FIG. 1) so as to enable a quick emptying of the antechamber in the case of failures that may occur during pulling of a rod, as for example in the case of breaking off or breaking down of the rod stem.

Figure 3:
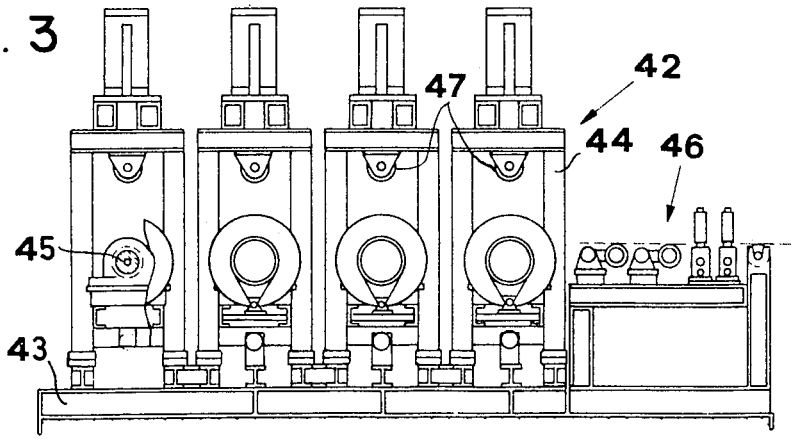
FIG. 3 is a side view of a pulling equipment assembly of an oven unit for a continuous rod casting equipment line in accordance with the invention.
Figure 4:
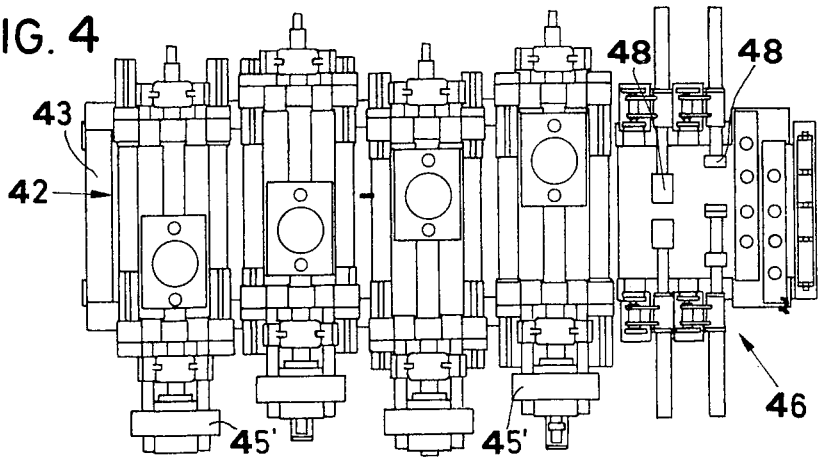
FIG. 4 is a plan view of the pulling equipment assembly of FIG. 3.

Immediately following the roller table unit symbolized by the roller 27 in FIG. 1 is a pulling equipment assembly 42, illustrated in FIGS. 3 and 4, that comprises a number of movable standards or frames 44 arranged in a main framework 43, the number of unit frames 44 corresponding to the largest number of rod stems to be pulled at the same time from the mold-equipped oven unit.

In each frame unit 44 a pulling roll 45 is mounted in suitable bearings and arranged to be driven by a controllable drive 45'. The pulling rolls 45 serve to pull the rod stem out of the chill mold 23. A hydraulic motor constructed as a slow-running motor is particularly suitable for the drive 45', especially such a motor impelled by fluid reaching it through a servo valve of the kind that may be described as an electrohydraulic amplifying signal transducer. The drive 45' must have an operating characteristic that is as smooth as possible and is adjustable. The pulling velocity is continuously variable (i.e. in a step-less fashion). The control of the drive 45' is carried out either by hand or by a control system utilizing a measuring station 46 for the sensing function. The pulling rolls 45 may be chosen to be controllable all together, by pairs or individually, so that synchronous running can be provided to the extent desired. Pressure rollers 47 arranged to be vertically adjustable are provided above the pulling rolls 45 to press the rod stem against the pulling rolls.

The pulling equipment assembly 42 can be rearranged according to the number of rod stems to be pulled. For this purpose the frame standards 44 with their respective pulling rolls 45, drives 45' and pressure rolls 47 are individually shiftable as a unit transversely of the pulling direction. The axes of rotation of the respective pressure rolls 47 are however not quite rigidly fixed, so that in the case of a multi-stem operation small differences of orientation of the rod stems can be compensated for by a slight inclination of the axes of the pressure rollers 47 to each other. The applied force of the pressure rollers 47 can be fitted to the particular cross section being pulled through the equipment at the time by compressed air, for example.

A measuring station 46 is provided immediately downstream of the pulling equipment assembly 42 for control of the pulling process by means of a control system that need not be illustrated further here. In the measuring station 46 measuring rollers 48 in contact with the underside 45 of the rod stem or stems are used as sensors for the advance of each stem. The signal of each of the measuring rollers 48 is compared with a programmed value in the aforesaid control system to produce an error signal by reference to which the advance movement of the rod stems, as produced by the corresponding drive 45', is controlled.

As already mentioned, following the measuring station 46, a notching and length-severing equipment is provided, as illustrated in my aforesaid companion application, for cutting up each rod stem into rods of predetermined length.

Although the invention has been described with respect to particular embodiments, other variations are of course possible within the inventive concept.

I claim:

1. In a continuous rod casting equipment line for horizontally forming and pulling one or more rod stems, a mold and oven unit, comprising, in combination:

reservoir oven means (2) for intermittently receiving quantities of casting melt and controllably discharging the casting melt downwardly in molten condition;

mold assembly means composed of at least two individual mold assemblies (15,16), each provided with a continuous-casting chill mold (23,24) and forming therewith an antechamber for the mold, said mold being assembled as part of said mold assembly so as to form a side of said antechamber and to provide for continuous casting in a manner in which the cast material moves horizontally out of the mold, said antechamber formed by said mold assembly being capable of containing a quantity of melt for the mold sufficient for assuring continuity of the casting operation while the mold assembly is supplied with melt from said reservoir oven means (2), and a positioning turntable (17), having a base (18) providing a rotatable mount therefor and having a plurality of locations at which the respective mold assemblies are fixably mountable on the rotatable part of said turntable (17), said turntable being mounted on its said base so as to be rotatable between a plurality of predetermined orientation positions in each of which one of said mold assemblies mounted on said table is placed in a predetermined operating position, in which it can receive melt discharged from said oven means (2), and another mold assembly thereon is simultaneously placed in a standby position, in which it can be replaced and its replacement mounted, trued up and preheated.

2. A mold and oven unit for a horizontal continuous rod casting equipment line as defined in claim 1, in which said mold assembly means consists of two mold assemblies and in which said positioning turntable (17) is provided with two locations on opposite sides of said turntable for respectively mounting said two mold assemblies (15,16).

3. A mold and oven unit for a horizontal continuous rod casting equipment line as defined in claim 1, in which each mold assembly (15,16) is provided with interchangeable front plate means (25,26) for mounting a continuous casting chill mold (23,24) and in which each front plate means (25,26) is so shaped and arranged that regardless of the cross-sectional shape and magnitude of the mold mounted thereon, the bottom of the effective mold surface is at the same predetermined level when the respective front plate means is incorporated in the respective mold assembly.

4. A mold and oven unit for a continuous rod casting equipment line as defined in claim 1 in further combination with a rod stem pulling means (22) provided with a plurality of pulling drive units disposed one behind the other in the direction of rod stem pulling, each of which pulling drive units comprises a standing frame (24), a pulling roller (25) provided with a drive therefor mounted on said frame and a pressure roller (27) likewise mounted on said frame, each rod stem pulling unit being shiftable as a unit transversely to the rod stem pulling axis or axes.

* * * * *